US005613380A

United States Patent [19]

Savkar

[11] Patent Number: 5,613,380

[45] Date of Patent: Mar. 25, 1997

[54] COIL SPRING AND SNUBBER SUSPENSION SYSTEM FOR A WASHER

[75] Inventor: Sudhir D. Savkar, Schenectady, N.Y.

[73] Assignee: General Electric Company, Schenectady, N.Y.

[21] Appl. No.: 574,014

[22] Filed: Dec. 18, 1995

Related U.S. Application Data

[63] Continuation-in-part of Ser. No. 539,889, Oct. 6, 1995, Pat. No. 5,520,029, and Ser. No. 283,726, Aug. 1, 1994, Pat. No. 5,528,913.

[51] Int. Cl.[6] ..... D06F 37/24

[52] U.S. Cl. ..... 68/23.3; 68/23.1; 248/610; 248/638

[58] Field of Search ..... 68/12.06, 23.1, 68/23.3; 210/144; 494/82; 248/562, 638, 611, 613, 612, 610; 34/58

[56] References Cited

U.S. PATENT DOCUMENTS

| | | | |
|---|---|---|---|
| 2,396,105 | 3/1946 | Kirby | 68/23.3 |
| 2,575,689 | 11/1951 | Smith | 68/23.5 |
| 2,693,098 | 11/1954 | Young | 68/23.3 |
| 3,494,471 | 2/1970 | Grippo | 68/23.3 |
| 3,744,746 | 7/1973 | Weir et al. | 68/23.3 |
| 3,854,308 | 12/1974 | Czech et al. | 68/23.3 |
| 4,202,187 | 5/1980 | Hukuzawa et al. | 68/23.3 |
| 4,475,363 | 10/1984 | Thomson | 68/23.3 |

FOREIGN PATENT DOCUMENTS

| | | | |
|---|---|---|---|
| 1370624 | 7/1964 | France | 68/23.1 |
| 1418762 | 10/1985 | France | 68/23.1 |
| 2327339 | 12/1974 | Germany | 68/23.1 |
| 2327340 | 12/1974 | Germany | 68/23.1 |
| 2348052 | 4/1975 | Germany | 68/23.1 |
| 62-40040 | 5/1979 | Japan | 68/23.3 |
| 63-15998 | 1/1988 | Japan | 68/23.3 |
| 63-189198 | 8/1988 | Japan | 68/23.3 |
| 63-229094 | 9/1988 | Japan | 68/23.3 |
| 63-296799 | 12/1988 | Japan | 68/23.3 |
| 64-64692 | 3/1989 | Japan | 68/23.3 |
| 403697 | 6/1966 | Switzerland | 68/23.1 |

*Primary Examiner*—Frankie L. Stinson
*Attorney, Agent, or Firm*—Marvin Snyder

[57] ABSTRACT

A suspension mounts a tub to a housing in a clothes washer. The suspension includes a coil spring having first and second loops at opposite ends thereof, and an integral rod joined thereto. A one-piece snubber has a resilient middle portion and opposite first and second lugs disposed inside the coil spring, with the first lug being aligned with the first loop, and the second lug being aligned with the second loop. The snubber middle portion includes a sidewall defining a cavity which changes in volume in response to excursions between the first and second lugs. The rod has a proximal end for joining one end of the spring to the washer housing, with the other end of the spring being joinable to the tub so that the snubber and spring cooperate together to provide a variable spring and damper suspension supporting the tub.

17 Claims, 4 Drawing Sheets

COIL SPRING AND SNUBBER SUSPENSION SYSTEM FOR A WASHER

CROSS REFERENCE TO RELATED APPLICATION

This is a continuation-in-part of patent application Ser. No. 08/539,889, filed Oct. 6, 1995, now U.S. Pat. No. 5,520,029, entitled "Coil Spring and Snubber Suspension System for a Washer;" and a continuation-in-part of patent application Ser. No. 08/283,726, filed Aug. 1, 1994, now U.S. Pat. No. 5,528,913, entitled "Washing Machine with Snubbers for Limiting Unbalanced Load Vibration Excursions."

TECHNICAL FIELD OF THE INVENTION

The present invention relates generally to a clothes washing machine, and, more specifically, to a suspension system therein.

BACKGROUND OF THE INVENTION

A vertical axis clothes washing machine includes a tub containing a basket having an oscillating agitator to wash clothes placed therein. The tub is mounted by a suspension typically including springs and dampers.

During operation of the washing machine, an unbalanced load of clothes or other articles may cause the basket to spin or rotate off-axis and may cause the tub containing the basket to vibrate. The vibration excursions tend to be especially acute during the start of the spin cycle. At the beginning of the spin cycle, the excursions may become large enough, as the machine passes through resonance of the suspension, for the tub to bang against the washer housing. As the washer spin cycle progresses, the rotational speed of the basket increases, and the excursions tend to be limited at speeds beyond the resonance of the suspension.

Stiffening the suspension will keep the tub aligned, but permanently stiffening the suspension will increase the suspension frequency causing the machine to pass through resonance at a higher, more damaging speed. Accordingly, it will be appreciated that it would be highly desirable to temporarily stiffen the washer suspension to keep the tub aligned without permanently increasing the stiffness of the suspension.

Furthermore, typical suspensions require many parts which are expensive to manufacture. A typical damper includes a housing and piston therein which are separately manufactured components, and are also subject to friction wear during operation.

It is therefore also desirable to have a relatively simple and inexpensive suspension with few components.

SUMMARY OF THE INVENTION

A suspension mounts a tub to a housing in a clothes washer. The suspension includes a coil spring having first and second loops at opposite ends thereof, and an integral rod joined thereto. A one-piece snubber has a resilient middle portion and opposite first and second lugs disposed inside the coil spring, with the first lug being aligned with the first loop, and the second lug being aligned with the second loop. The snubber middle portion includes a sidewall defining a cavity which changes in volume in response to excursions between the first and second lugs. The rod has a proximal end for joining one end of the spring to the washer housing, with the other end of the spring being joinable to the tub so that the snubber and spring cooperate together to provide a variable spring and damper suspension supporting the tub.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
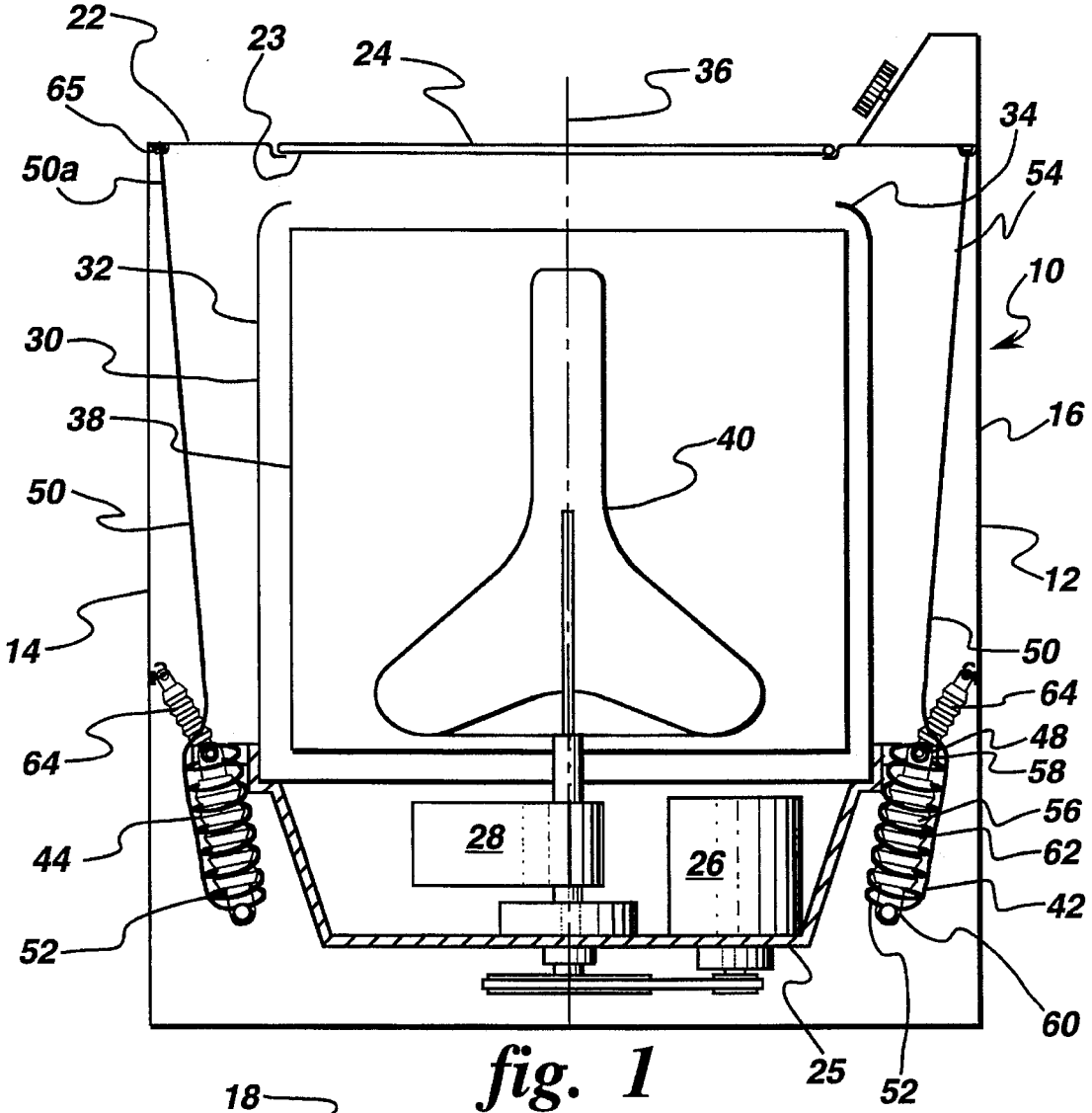
FIG. 1 is a diagrammatic side view of a washer according to the present invention with a right side panel removed to illustrate a preferred embodiment of a coil spring and snubber suspension.
Figure 2:
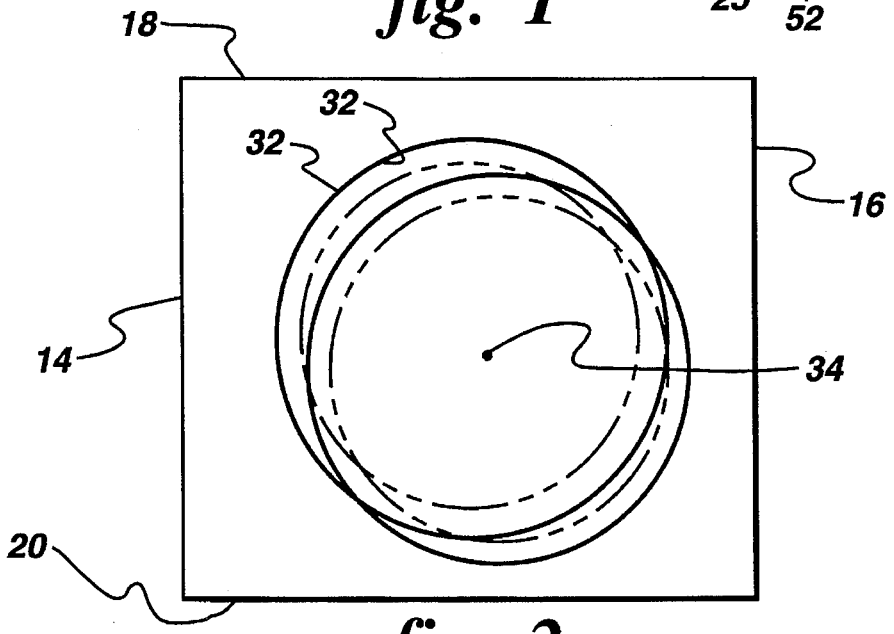
FIG. 2 is a diagrammatic top view of the washer of FIG. 1 illustrating tub excursions.

Referring to FIGS. 1 and 2, a washing machine 10, for washing a load of articles of clothing and the like, has a housing 12 containing front and rear panels, 14, 16, left and right panels 18, 20, and a top panel 22. An opening 23 is provided in top panel 22 for loading articles in machine 10. A pivotal closure panel 24 is provided for opening 23. Typically, one of the front and rear panels 14, 16 is removable for access to the interior mechanisms of the washing machine 10.

Within the housing 10 is a mounting platform 25 with a motor 26, a transmission assembly 28 and a tub assembly 30 mounted thereon. As illustrated, the motor 26 and transmission 28 are positioned on a lower portion of the platform 25 while the tub assembly 30 is mounted on the platform 25 above the motor 26 and transmission 28. As is known in the art, the transmission 28 and a wash basket 38, mounted in the tub assembly 30, are connected via a shaft. Positioning the transmission 28 on the platform 25 below the tub assembly 30 lowers the center of gravity of the washer 10 which encourages more stable operation.

The tub assembly 30 has a tub 32 with a top edge portion 34, and vertical axis 36 and is positioned on the platform 25 in the housing 12 so that it is spaced from the housing panels 14, 16, 18, 20. The tub assembly 30 contains the basket 38 that is positioned in the tub 32 for holding the articles to be washed. The basket 38 contains an agitator 40 connected to the transmission 28 via a shaft. The transmission 28 transfers energy from the electric motor 26 for operating the basket 38 and agitator 40 during the various cycles of operation of the washer 10. During a spin cycle, for example, the transmission 28 rotates the basket 38, along with the agitator 30, about the vertical axis 36 in a circular path with the basket 38 remaining vertically upright when the articles to be washed form a balanced load in the basket. When the articles in the basket form an unbalanced load, the basket 38 has a tendency to rotate askew of the vertical axis 36 in a noncircular path with the basket being urged from vertical on excursions. The basket excursions urge the tub 32 from its spaced position relative to the housing panels 14, 16, 18, 20.

At the beginning of a spin cycle, when the load is unbalanced, there may be severe excursions wherein the tub contacts a housing panel. Severe excursions are not only noisy and potentially damaging to the washer, but may cause the washer to move from its position on the floor and walk across the floor, especially where the floor is weak or uneven. Accordingly, most washers are equipped with a shut down system to turn the machine off when the excursions reach a predetermined magnitude or intensity.

Figure 3:
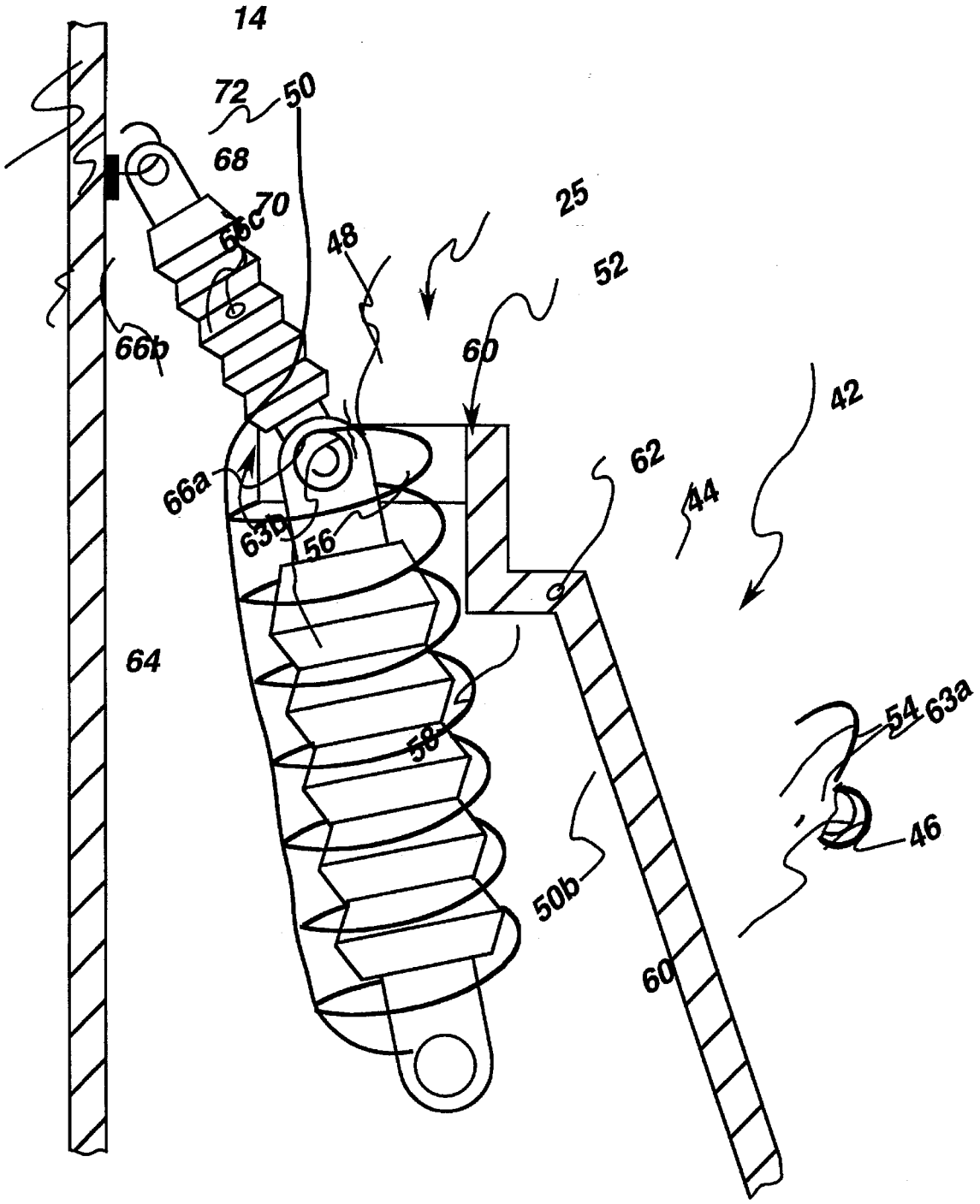
FIG. 3 is an enlarged perspective view of one of the suspensions shown in FIG. 1.

As shown in FIG. 1 and in enlarged detail in FIG. 3, a plurality of coil spring and snubber suspensions 42 provide support for tub 32 and basket 38 to minimize vibration. While two such suspensions are effective, three or four minimize most effectively the basket excursion effects. The three suspensions are positioned 120° apart around the tub 32. If four such suspensions are used, they are equally spaced around the tub 32 in a preferred embodiment.

Each coil spring and snubber suspension 42 has a coil spring 44 with first and second mounting loops 46 and 48 at opposite ends thereof and an elongate extension rod 50 integrally formed with the spring 44. A first snubber 52 is positioned inside the coil spring 44. The snubber 52 is a resilient member that has a first end portion with a first mounting lug 54, a second end portion with a second mounting lug 56, and a resilient middle portion 58 intermediate the end portions. Each of the lugs 54 and 56 contains an aperture 60. The snubber 52 is preferably constructed of a synthetic resinous material that can be molded into the configuration desired, such as polypropylene, for example.

Preferably, the resilient middle portion 58 of the snubber 52 has a sidewall defining a first cavity and also defining at least one orifice 62 that provides a passageway for ingress and egress of air to the cavity during a change in volume. The orifice meters the air so that the resiliency of the snubber middle portion 58 is greater for low frequency excursions than for high frequency excursions. The sidewall may be thickened around the orifice 62 for reinforcement. The orifice may be fitted with or formed with a nipple for directing the air to an out of balance load sensor which shuts down the washer during certain conditions.

Preferably, the snubber has an enclosure with walls in which the sidewall has folds, like a fan or like the bellows of an accordion, to easily accommodate the change in volume and to easily fit in the coil spring 44. The snubber may have a plurality of cavities. Where there are a plurality of cavities, more than one cavity may have an orifice. Cavities may have multiple orifices, a single orifice, or no orifice at all. Cavities not having an orifice may still change in volume by compressing or expanding the air confined therein.

The first snubber 52 is positioned inside the coil spring 44 and has its first lower end lug 54 attached to the first mounting loop 46 of the coil spring 44 by a suitable first fastener 63a, such as a rivet, through loop 46 and aperture 60 in lug 54. Other means of attachment, such as a nut and bolt, can be employed. The second upper end lug 56 is attached through its aperture 60 to the second mounting loop 48 of the coil spring by a suitable second fastener 63*b*, such as a rivet or removable bolt and nut, through loop 46 and aperture 60 in lug 56. The fastener 63*b* attaches also the upper end of the coil spring 44 to the upper edge of platform 25. The extension rod 50 of suspension 42 extends from the lower end of spring coil 44 and has a crimped proximal end 50*a* forming a ball suitably attached to the inner surface of top panel 22 in a ball and socket joint 65 for example.

The middle portion 58 has a sidewall defining a first cavity therein which changes in volume in response to predetermined basket excursions to thereby minimize effects of the basket excursions. The sidewall defines at least one orifice 62 providing a passageway for metering air from the cavity during a change in volume so that the resiliency of the snubber decreases for high frequency excursions to thereby stiffen the coil spring body during high frequency excursions.

A second snubber 64 of the same size or different size from first snubber 52 has a first end portion with a mounting lug 66*a*, a second end portion with a mounting lug 66*b*, and a resilient middle portion 66*c* intermediate the end portions. Both lugs have an aperture 68 therein. The second snubber is made of the same material as the first snubber. The middle portion 66*c* has a sidewall defining a first cavity therein which changes in volume in response to predetermined basket excursions as does the first snubber. Orifice 70 provides an air passageway. The first and second snubbers may be separate units or may be integrally formed as one-piece with a common middle lug 56 and 66*a*.

The second snubber 64 has its top lug 66*b* affixed to the inner surface of one of the washing machine panels by means, for example, of a hook 72 extending through aperture 68 and welded to the panel. The opposite end lug 66*a* is attached through its aperture to upper lug 56 of first snubber 52 prior to riveting lugs 66*a* and 56, and loop 48 together and to the upper edge of platform 25.

During operation, in response to large, low frequency tub excursions at the start up of a spin cycle, air in each snubber enters and exits through its orifice as the volume of the cavity changes to absorb the energy of the excursion to effect gas damping. The second snubber 64 limits the final volume of its cavity and the rate at which air enters and exits the cavity to control excursions. The first snubber 52 works directly in cooperation with the coil spring 44 as a gas damper or additional spring.

Initially, with the coil spring 44 in its normal compression, a low frequency excursion tending to further compress the spring must also compress the first snubber. The first snubber 52 is free to compress to empty its cavity, then it provides additional stiffness to work as a spring in conjunction with the spring 44 operating in compression making the combination spring more resistant to compression from excursions. The spring 44 therefore initially works alone for taking up compressive or contractive low frequency excursions until the first snubber 52 is fully compressed, and then non-linear additional compression stiffness is provided by the compressed snubber.

With the coil spring 44 again in its normal compression, a low frequency excursion tending to expand the spring must also expand the first snubber. The first snubber 52 is free to expand to fill its cavity, then it stiffens the spring making the spring more resistive to expansion from excursions. The spring 44 therefore again initially works alone for resisting expansive low frequency excursions until the first snubber 52 is stretched, and then non-linear additional tension stiffness is provided by the stretched snubber. Of course, it will be understood by those skilled in the art that the resiliency of the snubber or size of the orifice or cavity may be changed to achieve a desired low frequency response with a particular coil spring.

In response to high frequency tub excursions after the start up of a spin cycle, air entering and exiting each snubber 52, 64 through its orifice, to change the volume of the cavity to absorb the energy of the excursion, is restricted by the size of the orifice. The second snubber 64 stiffens to control high frequency excursions. The first snubber 52 now works directly in cooperation with the coil spring as an additional spring.

Initially, with the coil in its normal compression, a high frequency excursion tending to further compress the spring must also compress the first snubber. The first snubber is not free to empty its cavity because the orifice is too small; so, it stiffens the spring making the spring 44 more resistant to compression from high frequency excursions.

With the coil spring again in its normal compression, a high frequency excursion tending to expand the spring must also expand the first snubber 52. The first snubber is not free to expand to fill its cavity because the orifice is too small; so again, it stiffens the spring making the spring 44 more resistant to expansion from high frequency excursions.

In the exemplary embodiment illustrated in FIGS. 1 and 3, the distal end of the rod 50 is integrally joined to the first loop 46 positioned vertically below the spring 44, with the rod proximal end 50*a* being pivotally joined to the washer top panel 22 for suspending the tub 32. The second loop 48 is disposed between the first loop 46 and the rod proximal end 50*a* vertically above the first loop 46, with the second loop 48 and second lug 56 being joined to the tub 32 at the adjacent portion of the platform 25. In this arrangement, the dead weight of the tub 32, and the other washer components joined thereto, place the respective springs 44 in compression.

The first lug 54 is aligned with the first loop 46 to define a first joint held together by the fastener 63*a*. The second lug 56 is aligned with the second loop 48 to define a second joint held together by the fastener 63*b* which also fixedly attaches the second joint to the tub 32 through the platform 25 for suspending the tub 32 from the housing 12 so that vibratory excursions expand and contract together both the snubber 52 and coil spring 44.

Since the first loop 46 is disposed below the second loop 48, the rod 50 preferably includes a parallel offset portion 50*b*, as illustrated in FIG. 3, which is spaced laterally away from the spring 44 and snubber 52 between the first and second loops 46, 48. The offset 50*b* allows the top portion of the rod 50 to be aligned coaxial with the snubber 52 and spring 44 to provide a substantially straight load path therethrough for providing substantially straight line contraction and expansion of the spring 44 during operation.

Figure 4:
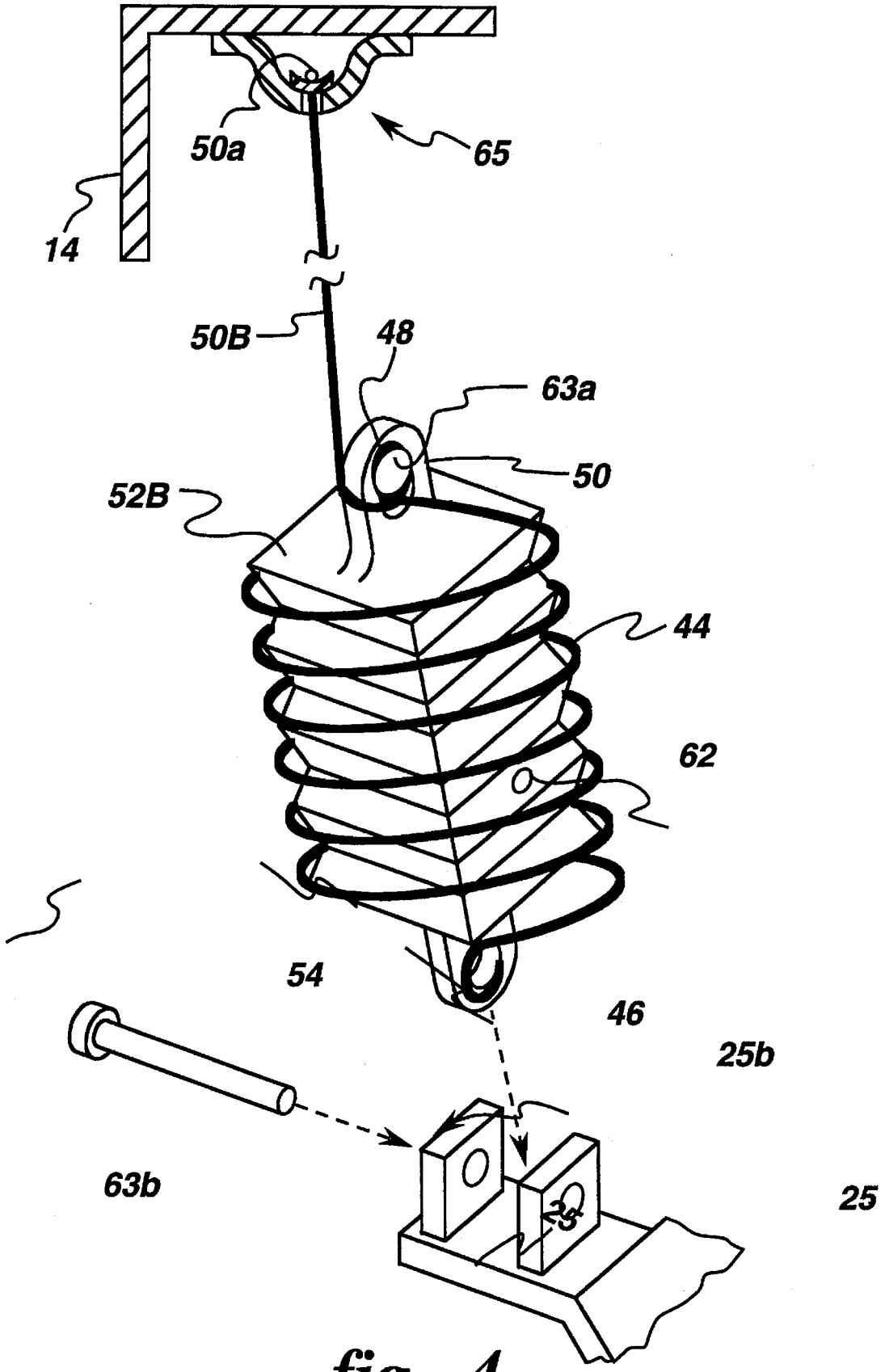
FIG. 4 is a schematic representation of a coil spring and snubber suspension in accordance with another embodiment of the present invention.

Illustrated in FIG. 4 is another embodiment of the present invention wherein the rod, designated 50B, is instead joined directly to the top second loop 48. The second loop 48 is disposed between the first loop 46 and the rod proximal end 50*a*, with the first loop 46 being joined to the tub 32 by the platform 25, with the fastener or bolt 63*b* extending through the first joint defined by the first loop 46 and lug 54, and through a corresponding clevis 25*b* on the platform 25. The second joint defined by the second loop 48 and lug 56 is held together by the fastener or rivet 63*a*. The rod 50B is preferably straight and generally aligned coaxially with both the spring 44 and snubber, designated 52B in an alternate square embodiment. In this arrangement, the dead weight of the tub 32 places the spring 44 in tension.

Both the cylindrical snubber 52 illustrated in FIG. 3 and the square snubber 52B illustrated in FIG. 4 are functionally equivalent. Each snubber is preferably in the form of a bellows, and has an internal cavity therein. The bellows may be provided either with or without the communicating orifice 62 as desired. The orifice 62 is preferred for providing flow communication of the ambient air with the inside of the cavity, and is preferably sized for metering airflow into and out from the cavity for providing air damping in response to vibratory excursions of the two ends of the spring 44 as the tub 32 moves during washer operation.

The orifice 62 also allows each snubber 52, 52B to function as both a gas damper and a gas spring. For example, during sudden loads causing large excursions between the ends of the spring 44 the expulsion of air through the orifice 62 will be limited. The bellows snubber will then act as a stiffening gas spring, increasing the stiffness of the suspension assembly. This will serve to limit the size of the excursions in the early transient out of balance condition. Conversely, when the excursions of the spring 44 are low frequency and the resultant pressure fluctuations in the bellows snubber small, the bellows snubber will operate as a pure gas damper. The transition from gas damper to gas spring is readily variable by correspondingly sizing the orifice 62. Although one orifice 62 is illustrated, several orifices 62 could also be used if desired.

Both embodiments illustrated in FIGS. 3 and 4 are relatively simple in manufacture, and are therefore relatively inexpensive to produce. Each coil spring 44 is conventionally manufactured as wound wire, with the straight rod 50 simply being an integral extension thereof. The first and second loops 46, 48 are also simply wound and may include one or more complete loops for ensuring suitable strength and rigidity of the assembled spring 44 and snubber 52, 52B. In the FIG. 3 embodiment, the rod 50 extends from the first loop 46 and includes the simple parallel offset 50*b* which is provided by suitably bending the wire. And in the FIG. 4 embodiment, the rod 50B is merely an integral extension of the spring 44 at the second loop 48.

The snubbers 52, 52B may be conventionally manufactured using blow molding which produces an inexpensive one-piece snubber. The snubbers may be cylindrical, or square, or any other suitable configuration. The snubbers may be formed of a suitable elastic or resilient material such as polypropylene, or they could also be made of a suitable metal or alloy. Blow molded plastic is preferred since it provides a suitably elastic snubber which may be stretched into position within the coil 44 by initially elastically displacing either of the loop ends of the coil 44. Or, the loop ends of the coil 44 may be formed after the snubber is inserted inside the coil 44.

Accordingly, the spring 44 and integral rod 50 form a one-piece component bent from a single strand of spring wire, and the individual snubbers are also one-piece components, each separately manufactured in simple and inexpensive processes. The assembled two components define each of the suspensions 42 which are installed between the housing 12 and the tub 32 by using the simple fasteners 63*a,b*.

As indicated above with respect to FIG. 3, the first snubber 52 works in conjunction with the coil spring 44 as a gas damper or gas spring depending upon the speed of the excursions between the spring loops 46, 48. The first snubber 52 is therefore aligned primarily vertically for supporting the weight of the tub 32, with the second snubber 64 being aligned in part laterally for acting as an out of balance snubber for lateral or horizontal excursions of the tub 32 during operation. The first and second snubbers 62, 64 may be separate components as illustrated in FIG. 3, or as illustrated in FIG. 5 they may be integrally joined together at a common lug in a one-piece component.

Figure 5:
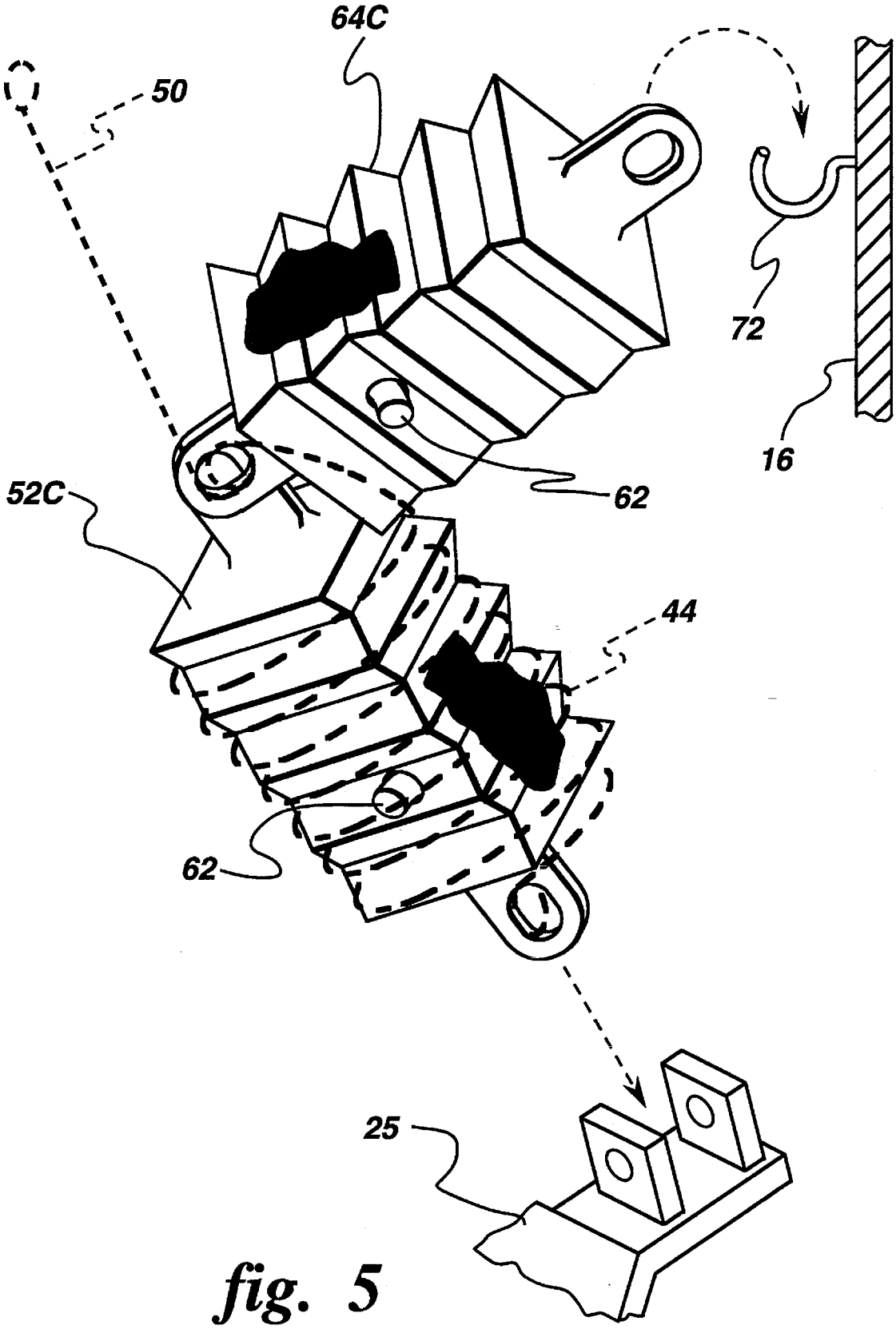
FIG. 5 is a schematic representation of a one-piece double snubber for use with a coil spring in accordance with another embodiment of the present invention.

In the embodiment illustrated in FIG. 5, the first snubber is positioned inside the spring 44, and designated 52C, with the second snubber designated 64C being disposed outside the spring 44 and fixedly integrally joined at one end thereof to the first snubber 52C. The opposite end of the second snubber 64C is joined to the housing at one of its panels using the hook 72 for example. The second snubber 64C operates primarily in the lateral direction, whereas the first snubber 52C operates primarily in the vertical direction. Each snubber preferably has an internal cavity, as shown cut away in part in the first snubber 52C, with a corresponding orifice 62 communicating with each of the cavities. Each snubber may function both as a gas damper and as a gas spring as desired by simply controlling the size of the respective orifices 62.

While the invention has been described with particular reference to the preferred embodiments, it will be understood by those skilled in the art that various changes may be made and equivalents may be substituted for elements of the preferred embodiments without departing from invention. For example, other configurations of snubbers other than cylindrical may be used and the snubbers and spring may be attached at locations along the panels, tub and platform other than those illustrated. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the resiliency of the snubber or size of the orifice or cavity may be changed to achieve a desired high frequency response with a particular coil spring. It is accordingly intended that the claims shall cover all such modifications and applications as do not depart from the true spirit and scope of the invention.

What is claimed is:

1. A machine for washing articles, comprising:

a housing having a front panel, rear panel, top panel with opening, closure panel, left panel and right panel;

a mounting platform within said housing;

a tub having a top portion and a vertical axis and being mounted on said platform within said housing at a position spaced from each of said housing panels;

a basket in said tub having a size sufficient for holding articles to be washed;

an agitator within said basket to facilitate washing of the articles;

means for imparting oscillating motion to the agitator during a wash cycle;

means for rotating said basket, said basket rotating about said vertical axis in a circular path with said basket remaining vertical when said articles form a balanced load in said basket, said basket tending to rotate askew of said vertical axis in a noncircular path with said basket urged from vertical on excursions when said articles form an unbalanced load in said basket, said basket excursions urging said tub from said spaced position relative to said housing panels; and a plurality of coil spring and snubber suspensions each having a coil spring attached at its upper end to the mounting platform, an extension rod of the coil spring from the lower end of the coil spring attached to the upper housing panel and a snubber positioned within and attached at opposite ends to the coil spring whereby the coil spring is loaded in compression and the snubber has a cavity therein and an aperture communicating therewith which changes in volume in response to predetermined basket excursions to minimize the effects thereof.

2. A washing machine, as set forth in claim 1, wherein the plurality of suspensions comprise three suspensions which are positioned 120° apart around the tub.

3. A washing machine, as set forth in claim 1, wherein the plurality of suspensions comprise four suspensions which are equally spaced around the tub.

4. A washing machine, as set forth in claim 1, wherein a second snubber has a first end connected to the upper end of coil spring, a second end connected to said housing panel, and a resilient middle portion extending between said ends, said middle portion having a sidewall defining a first cavity therein which changes in volume in response to predetermined basket excursions to thereby minimize effects of said predetermined basket excursions.

5. A washing machine, as set forth in claim 4, wherein said first and second snubbers are integrally formed.

6. A suspension for mounting a tub to a housing in a clothes washer comprising:

a coil spring having first and second loops at opposite ends thereof;

a rod integrally joined to one of said first and second loops, and having a proximal end for being joined to said washer for suspending said tub;

a one-piece snubber having a resilient middle portion and opposite first and second lugs, said middle portion including a sidewall defining a cavity which changes in volume in response to excursions between said first and second lugs; and said snubber being disposed inside said coil spring, with said first lug being aligned with said first loop in a first joint, and said second lug being aligned with said second loop in a second joint, with one of said first and second joints being fixedly attachable to said tub for suspending said tub from said housing so that said excursions expand and contract together both said snubber and coil spring.

7. A suspension according to claim 6 wherein said snubber is in the form of a bellows.

8. A suspension according to claim 7 wherein said snubber includes an orifice disposed in flow communication with said cavity and being sized for metering airflow into and out from said cavity for providing air damping in response to said excursions.

9. A suspension according to claim 8 wherein said spring and rod comprise a one-piece component, with said first and second loops being integral portions thereof.

10. A suspension according to claim 9 wherein said rod is joined to said first loop, and said second loop is disposed between said first loop and said rod proximal end for being joined to said tub to place said spring in compression due to tub weight.

11. A suspension according to claim 10 wherein said rod includes an offset spaced laterally away from said spring and snubber between said first and second loops.

12. A suspension according to claim 11 in combination with said washer mounting said tub to said housing.

13. A suspension according to claim 9 wherein said rod is joined to said second loop, and said second loop is disposed between said first loop and said rod proximal end, with said first loop being joinable to said tub to place said spring in tension due to tub weight.

14. A suspension according to claim 13 wherein said rod is substantially straight from said proximal end to said second loop.

15. A suspension according to claim 14 in combination with said washer mounting said tub to said housing.

16. A suspension according to claim 9 further comprising a second snubber disposed outside said spring and fixedly joined at one end to said first snubber, with an opposite end being joinable to said housing for damping lateral excursions of said tub.

17. A suspension according to claim 16 wherein said first and second snubber are integrally joined together at a common lug in a one-piece component.

* * * * *